US005524989A

United States Patent [19]

Ichioka et al.

[11] Patent Number: 5,524,989

[45] Date of Patent: Jun. 11, 1996

[54] PRINT ELEMENT ASSIGNMENT IN PRINTING APPARATUS

[75] Inventors: Yoshikazu Ichioka, Fujisawa; Hirobumi Katoh; Hiroshi Ohmichi, both of Yamato, all of Japan

[73] Assignee: International Business Machines Corporation, Armonk, N.Y.

[21] Appl. No.: 219,426

[22] Filed: Mar. 28, 1994

Related U.S. Application Data

[63] Continuation of Ser. No. 795,413, Nov. 20, 1991, abandoned.

[30] Foreign Application Priority Data

Nov. 27, 1990 [JP] Japan ..... 2-321356

[51] Int. Cl.[6] ..... B41J 2/30

[52] U.S. Cl. ..... 400/124.04; 400/124.02

[58] Field of Search ..... 400/124.04, 124.28, 400/124.02

[56] References Cited

U.S. PATENT DOCUMENTS

| | | | |
|---|---|---|---|
| 5,020,927 | 6/1991 | Niikawa | 400/121 |
| 5,030,021 | 7/1991 | Kamiya | 400/121 |
| 5,190,382 | 3/1993 | Koshiishi et al. | 400/124.28 |
| 5,242,231 | 9/1993 | Lehmann et al. | 400/124.04 |

*Primary Examiner*—Christopher A. Bennett
*Assistant Examiner*—Steven S. Kelley
*Attorney, Agent, or Firm*—Michael E. Belk

[57] ABSTRACT

The invention relates to a printing apparatus in which at least two printing elements are arranged a predetermined distance apart in a line parallel to the print direction. When two dots to be printed are the same predetermined distance apart as the print elements, only one of those print elements is used to print those dots.

21 Claims, 11 Drawing Sheets

| DOT POSITIONS | P1 | P2 | P3 | P4 | P5 |
|---|---|---|---|---|---|
| | B | | | | A |
| PRINTING WIRES | ● | • | • | • | ● |
| (1) | B | X | X | X | B |
| (5) | B | A | B | X | B |
| (6) | B | A | X | A | B |
| (7) | B | X | B | A | B |

FIG.2

| DOT POSITIONS | P1 | P2 | P3 | P4 | P5 |
|---|---|---|---|---|---|
| | B | | | | A |
| PRINTING WIRES | ● | • | • | • | ● |
| (1) | B | X | X | X | A |
| (2) | B | A | X | X | B |
| (3) | B | X | A | X | B |
| (4) | B | X | X | A | B |
| (5) | B | A | B | X | A |
| (6) | B | A | X | B | A |
| (7) | B | X | A | B | A |
| (8) | B | A | B | A | B |

FIG.20

PRINT ELEMENT ASSIGNMENT IN PRINTING APPARATUS

This application is a continuation of application Ser. No. 07/795,413 filed on Nov. 20, 1991 which is now abandoned.

FIELD OF THE INVENTION

This invention relates to a printing apparatus in which at least two printing elements are arranged at a predetermined distance in the printing direction, said two printing elements being moved relative to a printing medium in the printing direction, and more particularly to a serial dot-matrix printer provided with printing wires as said two printing elements.

BACKGROUND OF THE INVENTION

A. Prior Art

FIG. 16 shows a conventional circuit for controlling the energization of the printing wires A and B of a serial dot-matrix printer in which two printing wires A and B are arranged at a distance every three dots in the printing direction (at a dot pitch of 4 for the printing wires) and moved in the printing direction while a printing medium is fixed. A data distribution circuit 200 receives a series of data including printing data (binary "1") indicating characters or images are to be printed at predetermined dot positions and non-printing data (binary "0") indicating that the characters or images are not to be printed and distributes alternately the printing data ("1") to the two wires A and B.

The data distribution circuit 200 comprises a synchronous flip-flop (hereinafter called "D-FF") 221, an exclusive OR gate (hereinafter abbreviated "XOR gate") 222, an inverter 223, AND gates 224 and 225, and a shift register 226. The shift register; 226 comprises four D-FFs 226P, 226Q, 226R, and 226S connected in series which correspond to the distance of three dots, that is, at a dot pitch of 4 between the wires A and B. A Q output of D-FF 221 is connected to one input of the XOR gate 222 and printing data and non-printing data are provided to the other input of the XOR gate 222. An output of the XOR gate 222 is connected not only to an input of the inverter 223 and one input of the AND gate 224, but to a D input of the D-FF 221. An output of the inverter 223 is connected to one input of the AND gate 225. To the other input of the AND gate 224 and the other input of the AND gate 225, printing data ("1") and non-printing data ("0") are provided. An output of the AND gate 225 is connected to an input of the first D-FF 226P of the shift register 226. Clock inputs of the D-FF 221 and the D-FFs 226P, 226Q, 226R, and 226S of the shift register are supplied with a continuous series of dot clock pulses indicating dot positions.

FIG. 17 shows the time charts of the operation of each part of the circuit shown in FIG. 16. As shown in FIG. 17, the output of the XOR gate 222 holds "1" (printing data) while receiving printing data ("1") and then subsequent printing data ("1"), even if non-printing data ("0") is received in a state where the subsequent printing data ("1") is not reached and then becomes "0" at a time when the subsequent printing data ("1") is reached. Printing data ("1") are alternately provided, through the AND gates 224 and 225, to the wires A and then B, respectively. The supply of printing data to the wire B is delayed by the four dot-time shift register 226 to compensate by three dots corresponding to a distance between the wires A and B. Printing data are distributed alternately to the wires A and B to accomplish high-speed printing, because a time is required for printing by a wire (for example, wire A) then following printing and therefore to accomplish high-speed printing, it is necessary to do printing by one wire (for example, wire B) while the other wire (for example, wire A) waits for printing.

FIG. 18 shows the assignment of printing data to the wires A and B in a case where continuous dots are printed by the wires A and B at a distance corresponding to three dots, that is, at a dot pitch of 4, as shown in FIG. 16.

FIG. 19 shows timing for driving the wires A and B and the energization of the wires A and B in a case where printing data are distributed, as shown in FIG. 18, to the wires A and B.

A circuit similar to the circuit shown in FIG. 16 is disclosed by Japanese Patent Application No. 1-309397.

B. Problem to be Solved by the Invention

FIG. 20 shows a sequence of eight dot lines each of which indicates five continuous dot positions P1, P2, P3, P4, and P5 in the printing direction and is assigned printing data at the first position P1 and the last positions P5. In the figure, circles and marks X indicate printing data and non-printing data, respectively. A or B in a circle indicates that printing data is distributed to the wire A or B, respectively. The conventional circuit shown in FIG. 16 assigns printing data alternately to the wires A and B and printing data are thus assigned as shown in FIG. 20.

In cases of (1), (5), (6), and (7) of FIG. 20, that is, cases where two printing data exist at a distance (of three dots) between the two printing wires A and B and no printing data exists or even printing data are present between the two printing data, the wires A and B are simultaneously energized to cause driving current to concentrate, that is, to increase driving current by twice that of printing by only one wire.

Japanese PUPA 57-160658 discloses that a distance between one printing element array comprising twelve printing wires and the other printing element array comprising 12 printing wires is set to several dots plus and a half dot to avoid a simultaneous energization of the two printing element arrays for one printing and to reduce peak current to be consumed to half. Such prior art, however, causes generation of timing signals to be complicated, since the distance between the two printing element arrays is not set to integral dots.

Japanese PUPA 61-74854 discloses that a distance between one printing element array and the other printing element array is set to n ½ m times of a basic pitch of a printing dot (n=1, 2, ..; m=2, 3, ..) to avoid a simultaneous energization of the two printing element arrays for one printing when high-density printing such as double-density or triple-density printing is done and to reduce consuming peak current. The prior art, however, causes generation of timing signals to be complicated since the distance between two printing element arrays is not set to integral dots.

SUMMARY OF THE INVENTION

An object of the invention is to provide a printing apparatus capable of avoiding simultaneous energizing of two printing elements arranged in the printing direction and also setting a distance between the two printing elements in the printing direction to integral dots.

A further object of the invention is to provide a printing apparatus capable of reducing the number of printing elements simultaneously energized in printing elements arranged in a plurality of lines in the printing direction.

The above objects art achieved according to the invention by providing a print apparatus with data assignment means for assigning two printing data at a distance corresponding to a distance between two printing elements in the printing direction to only one of the two printing elements. In this way the two printing elements are not simultaneously energized and the energy required for the printing operation can be decreased.

The invention further provides a print apparatus with printing assignment means for presetting a printing assignment of a plurality of printing element arrays each of which has a plurality of printing elements arranged in a plurality of lines in the printing direction with an integral dot offset in the printing direction, to each dot position of a printing medium. In this way the number of printing elements energized simultaneously in a plurality of lines can be previously controlled under printing assignment means so that the energy required for the printing operation can be decreased.

The foregoing and other objects, features and advantages of the invention will be apparant from the following more particular description of the preferred embodiments of the invention as illustrated in the accompanying drawings.

BRIEF DESCRIPTION OF THE DRAWINGS

FIG. 2 shows assignment of printing data of continuous five-dot pattern in which the printing data are at the first and the last dot positions to the printing wires A and B according to the embodiment of FIG. 1.

FIG. 20 shows wire assignment, by the circuit of FIG. 16, at five continuous dot positions the first and the last of which have printing data.

DETAILED DESCRIPTION OF THE INVENTION

Figure 1:
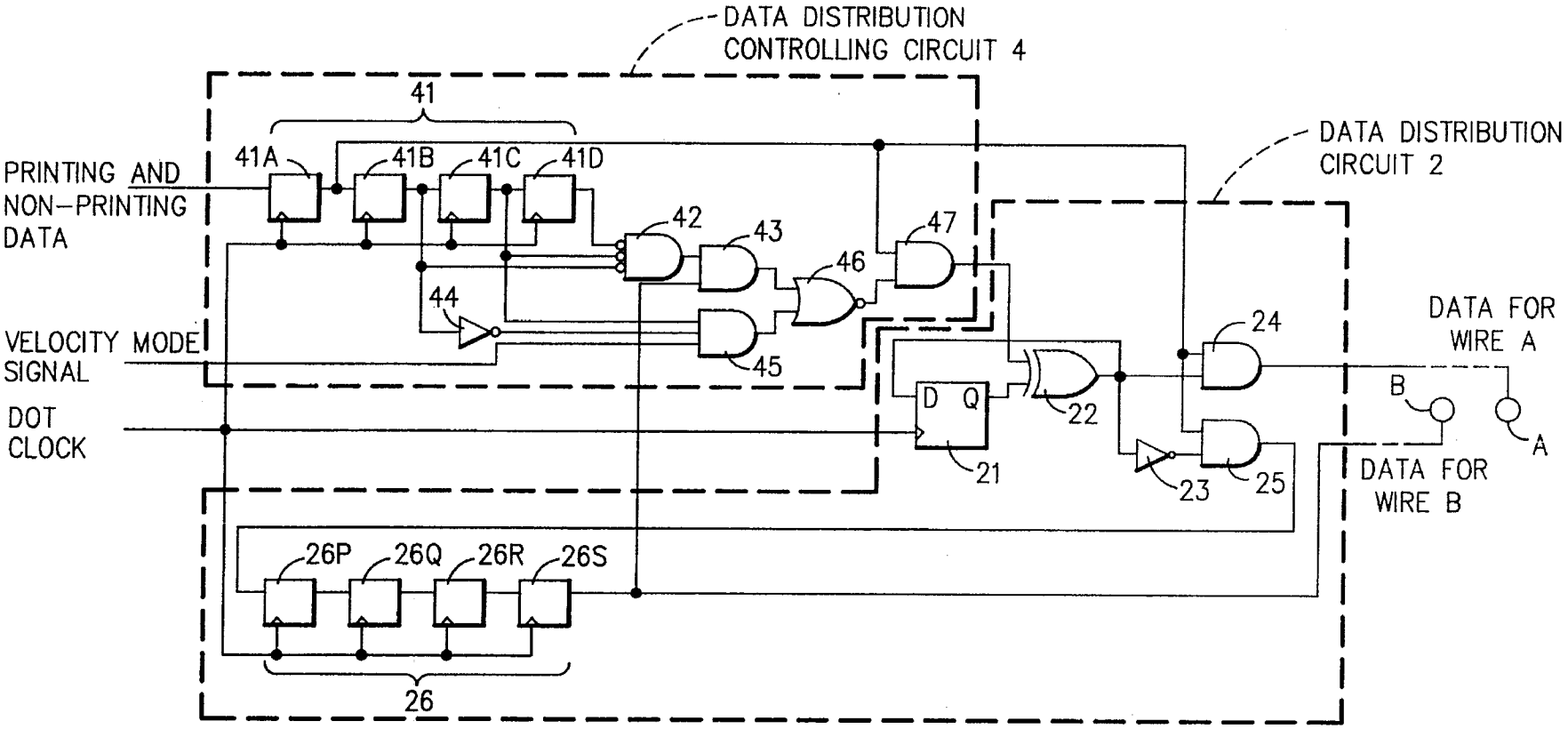
FIG. 1 is a block diagram showing an embodiment of a printing apparatus according to the present invention.

FIG. 1 shows an embodiment of a printing apparatus according to the present invention. The printing apparatus is a serial dot-matrix printer in which two printing wires A and B are arranged at a distance corresponding to three dots (that is, at a dot pitch of 4) and moved in the printing direction while a printing medium is fixed. Driving means capable of moving printing wires in the printing direction while a printing medium is fixed are well known. However, since such driving means do not fall into the scope of the present invention, further illustration and description are omitted. Moreover since also an actuator for energizing the printing wires A and B is well known, its description is omitted. An example of such an actuator is described in U.S. application Ser. No. 285,203 "Impact printer actuator using magnet and electromagnetic coil and method of manufacture" applied for on Dec. 16, 1988 by this applicant.

The printing apparatus of FIG. 1 includes a printing data distribution circuit 2 and a printing data distribution controlling circuit 4. The printing data distribution circuit 2 receives a series of data including printing data (binary "1") indicating that printing is to be done at a predetermined dot position to print a character or an image and non-printing data (binary "0") indicating that printing is not to be done and assigns alternately the printing data ("1") to two wires A and B.

The printing data distribution circuit 2 comprises a synchronous flip-flop (hereinafter called "D-FF") 21, an exclusive OR gate (hereinafter abbreviated "XOR gate") 22, an inverter 23, AND gates 24 and 25, and a shift register 26. The shift register 26 comprises four D-FFs 26P, 26Q, 26R, and 26S connected in series at a distance between the wires A and B corresponding to three dots, that is, at a dot pitch of 4. A Q output of the D-FF 21 is connected to one input of the XOR gate 22. Output from the printing data distribution controlling circuit 4 is supplied to the other input of the XOR gate 22. An output of the XOR gate 22 is connected not only to an input of the inverter 23 and one input of the AND gate 24, but to a D input of the D-FF 21. An output of the inverter 23 is connected to one input of the AND gate 25. The other input of the AND gate 24 and the other input of the AND gate 25 are supplied with printing data ("1") or non printing data ("0"), that is, a Q output of a D-FF 41A, which is the first stage of a shift register 1 in the distribution controlling circuit 4 described later. An output of the AND gate 25 is connected to an input of the first D-FF 26P of the shift register 26. To clock inputs of the D-FF 21, and the D-FFs 26P, 26Q, 26R and 26S in the shift register, continuous dot clock pulses indicating dot positions are provided.

Figure 15:
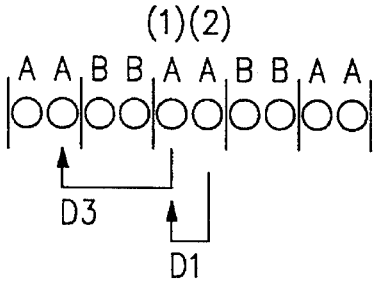
FIG. 15 shows printing dot patterns produced by the circuit of FIG. 14.
Figure 16:
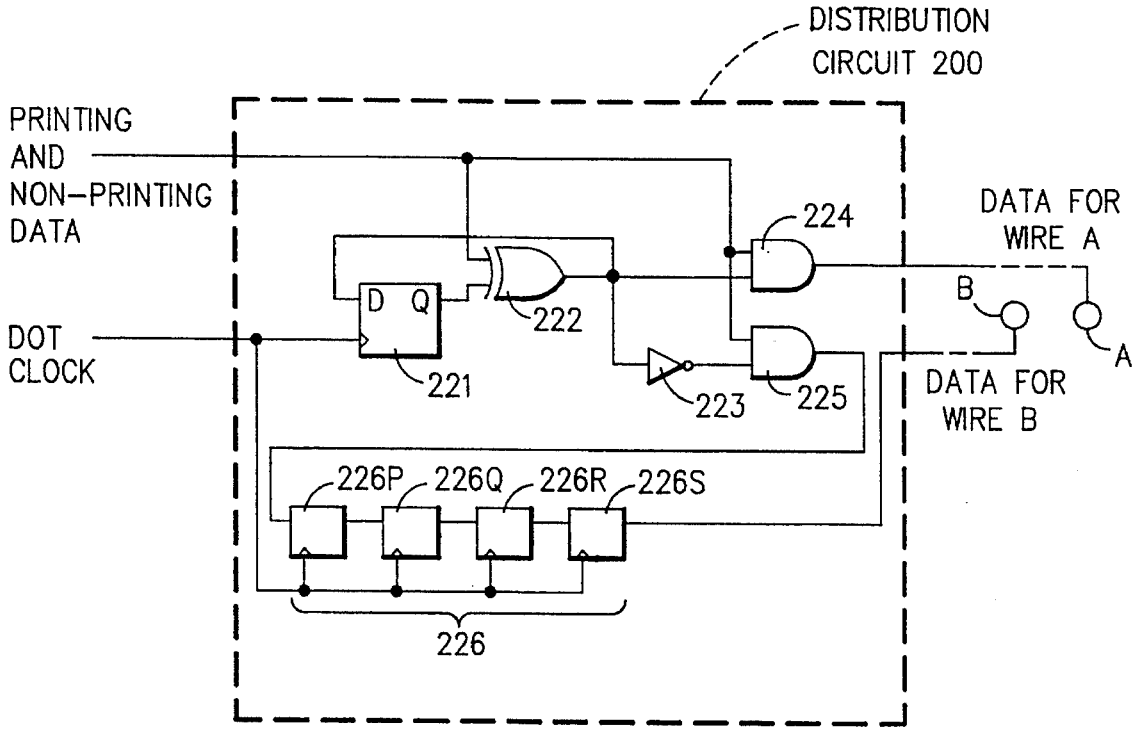
FIG. 16 is a block diagram showing an example of a conventional printing apparatus.
Figure 17:
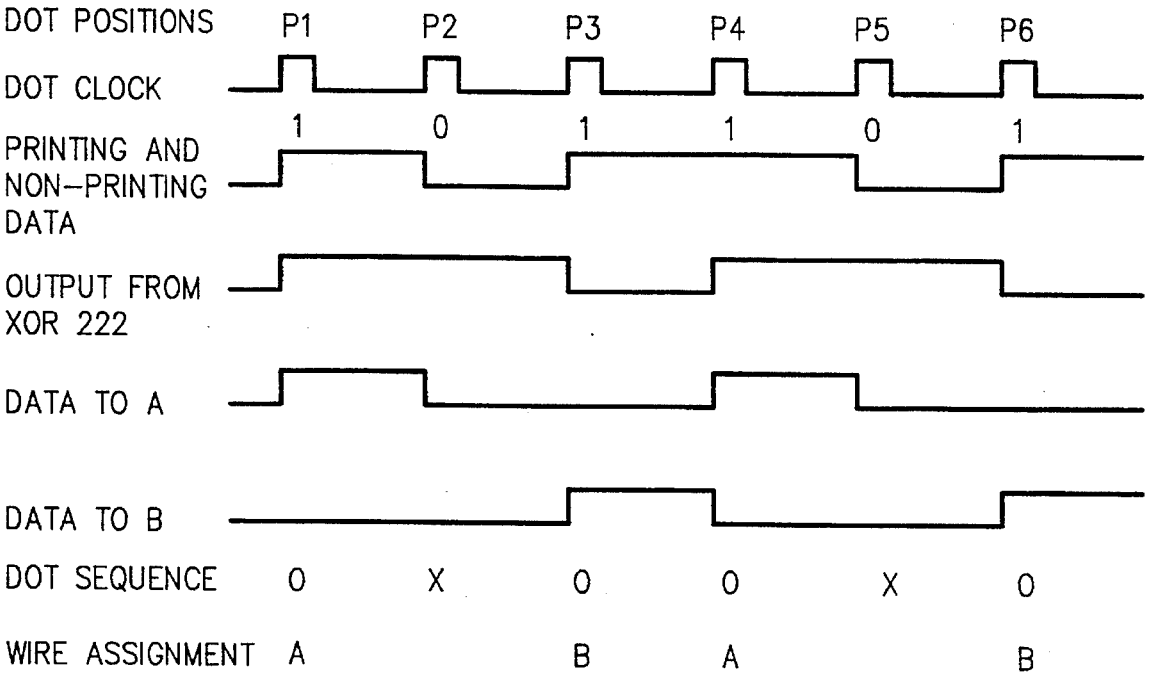
FIG. 17 shows time charts for the operation of each part in the circuit of FIG. 16.
Figure 18:
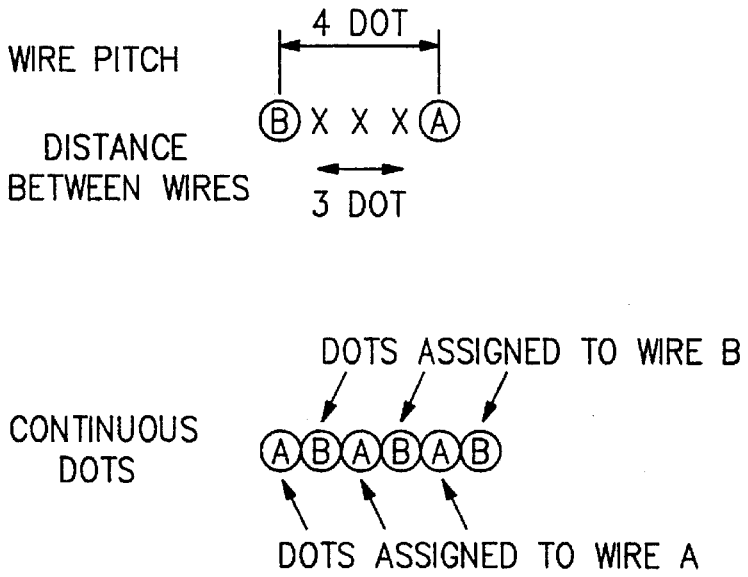
FIG. 18 shows assignment of wires A and B for printing continuous dots by the circuit of FIG. 16.
Figure 19:
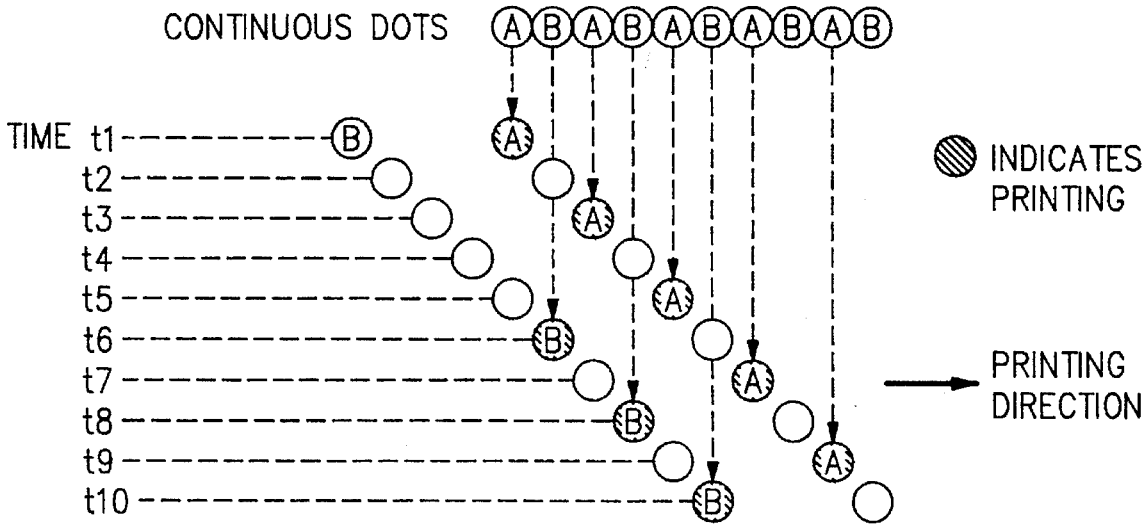
FIG. 19 shows the timing and the sequence of energization of the wires A and B for assignment to the wires A and B shown in FIG. 18.

The D-FF 21, the XOR gate 22, the inverter 23, the AND gates 24 and 25, and the shift register 26 in the printing data distribution circuit 2 correspond to the D-FF 221, the XOR gate 222, the inverter 223, the AND gates 224 and 225, and the shift register 226 in the conventional data assignment circuit 200 shown in FIG. 16, respectively. The printing data distribution circuit 2 shown in FIG. 1 differs from the printing data distribution circuit 200 shown in FIG. 16 in that the other input of the XOR gate 22 in FIG. 1 receives output from the data distribution controlling circuit 4, but the other input of the XOR gate 222 in FIG. 15 receives printing or non-printing data.

The distribution controlling circuit 4, when two printing data exists in a series of the above data with three-dot offset corresponding to a distance between the two printing wires A and B, controls the distribution circuit 2 so that to the same printing wire (for example, wire B) as a printing wire (for example, wire B), to which the preceding printing data of the two printing is assigned, the following printing data of the two printing data is assigned.

The distribution controlling circuit 4 comprises a shift register 41, a NOR gate 42, an AND gate 43, an inverter 44, an AND gate 45, a NOR gate 46, and an AND gate 47. The shift register 41 comprises four D-FFs 41A, 41B, 41C, and 41D connected in series, receiving, temporarily holding a series of data including printing and non-printing data, shifting the data by one dot position each time dot clock pulses are provided to clock inputs.

Three inputs of the NOR gate 42 connects to respective Q outputs of the D-FFs 41B, 41C, and 41D in the shift register 41 and an output of the NOR gate 42 connects to one input of the AND gate 43. To the other input of the AND gate 43, Q output of the D-FF 26S, which is a last stage of the shift register 26, that is, output to the printing wire B is supplied. An output of the AND gate 43 is connected to one input of the NOR gate 46.

A first input of the AND gate 45 is supplied with Q output of the D-FF 41C, which is a third stage of the shift register and a second input of the AND gate 45 with Q output of the D-FF 41B, which is a second stage of the shift register 41 through the inverter 44, and a third input of the AND gate 45 with a signal indicating a velocity mode. For normal velocity mode (in which a head moves by two dots per unit time and all dots are printed by two wires), the velocity mode signal is at the high level (binary "1") and for double velocity mode (in which the head moves by four dots per unit time), the velocity mode signal is at the low level (binary "0"). An output of the AND gate 45 is connected to the other input of the NOR gate 46. An output of the NOR gate 46 is connected to one input of the AND gate 47. The other input of the AND gate 47 is supplied with Q output of the D-FF 41A, which is the first stage of the shift register 41. An output of the AND gate 47 is connected to the other input of the XOR gate 22 in the distribution circuit 2.

The NOR gate 42 in the printing data distribution controlling circuit 4 is formed as a part of first detection means for generating a first detection signal ("1") indicating the detection of the presence of only non-printing data ("0") between two printing data ("1") separated from each other at a distance (by three dots) corresponding to a distance between the printing wires A and B. That is, the NOR gate 42, if Q outputs of the D-FFs 41B, 41C, and 41D, which are the second, the third, and the fourth stages of the shift register 41, respectively, are "0", outputs "1".

The AND gate 43, the NOR gate 46, and the AND gate 47 in the distribution controlling circuit 4 are formed into a first control means for controlling the printing data distribution circuit 2 in response to the above first detection signal so that a printing wire, which is a printing wire (for example B) to which the preceding printing data of two printing data separated from each other by three dots is assigned, is assigned the following printing data of the two printing data. That is, if the first detection signal ("1") is outputted from the NOR gate 42, output from the AND gate 43 becomes "1" (since Q output of the D-FF 26S, which is the last stage of the shift register 26 is "1"), output from the NOR gate 46 becomes "0", output from the AND gate 47 becomes "0", output from the XOR gate 22 in the distribution circuit 2 remains unchanged, and thus a wire (for example, wire B), which is a wire assigned the preceding printing data, is assigned the following printing data.

As shown above, according to the embodiment of FIG. 1, the first and the last dots of the dot patterns shown in FIG. 20(1) are printed, as shown in FIG. 2(1), by the same wire (for example, wire B). This means that the simultaneous energization of the wires A and B is not caused.

The inverter 44 and the AND gate 45 in the printing data distribution controlling circuit 4 forms second detection means for detecting printing data ("1") immediately after the first non-printing data ("0") between printing data ("1") separated from each other at a distance (by three dots) between the wires A and B in normal velocity mode to generate a second detection signal ("1"). That is, the AND gate 45, when its third input receives a signal ("1") indicating normal velocity mode, outputs "1" if the first and the second inputs receive Q output "1" of the D-FF 41C, which is the third stage of the shift register 41 and a signal "1" to which Q output "0" of the D-FF 41B, which is the second stage of the shift register 41, has been inverted by the inverter 44, respectively. The NOR gate 46 and the AND gate 47 in the distribution controlling circuit 4 form second control means for controlling the distribution circuit 2 in response to the above second detection signal ("1") so that a printing wire (for example, wire B), which is assigned printing data immediately before the first non-printing data ("0") between printing data ("1") separated from each other at a distance between the wires A and B, is assigned printing data immediately after the above first non-printing data. That is, when the AND gate 45 outputs the second detection signal ("1"), output from the NOR gate 46 becomes "0", output from the AND gate 47 becomes "0", output from the XOR gate 22 in the distribution circuit 2 remains unchanged and thus the wire, which is a wire (for example, wire B) assigned printing data immediately before the first non-printing data, is assigned printing data immediately after the first non-printing data.

In dot patterns (5), (6), and (7) shown in FIG. 20, printing data immediately before the first non-printing data are at dot positions P3, P2, and P1 respectively and printing data immediately after the first non-printing data are at dot positions P5, P4, and P3 respectively. According to the conventional circuit shown in FIG. 16, the printing data in the dot patterns (5), (6), and (7), shown in FIG. 20, at the dot positions P5, P4, and P3 are printed by the printing wires A, B, and A, respectively, and thus printing data at the dot positions P1 and P5 separated from each other at a distance between the wires A and B are printed by the wires A and B and the wires A and B are simultaneously energized. On the other hand, according to the embodiment of FIG. 1, printing data in the dot patterns (5), (6), and (7), shown in FIG. 20, at the dot positions P5, P4, and P3 are printed, as shown in (5), (6), and (7) of FIG. 2, by the printing wires B, A, and B and thus printing data at the dot positions P1 and P5 separated from each other at the distance between the wires A and B are printed by the same wire B and the wires A and B are not simultaneously energized.

However, if only the second detection means, which is a combination of the inverter 44 and the AND gate 45 and the second control means, which is a combination of the NOR gate 46 and the AND gate 47 in the embodiment of FIG. 1 are provided, a dot pattern (3) shown in FIG. 20 is printed only by one printing wire (for example, wire B). To avoid this, an embodiment of FIG. 3 not only provides two D-FFs 41X and 41Y at a front stage of the shift register 41, but also modifies the printing data distribution controlling circuit 4 into a printing data distribution controlling circuit 4B. The distribution controlling circuit 4B includes an inverter 48 which inverts Q output of the D-FF 41Y, an NAND gate 49 which receives output from the inverter 48 and Q output from the D-FF 41X, an AND gate 45A which receives output from the inverter 44 which inverts Q output from the D-FF 41B in the shift register 41 and Q output from the D-FF 41C, and an AND gate 45B which receives output from the AND gate 45A, output from the NAND gate 49, and a velocity mode signal. An output of the AND gate 45B connects to the other input of the NOR gate 46. Other interconnections of the distribution 35 controlling circuit are the same as in the distribution controlling circuit 4.

Figure 3:
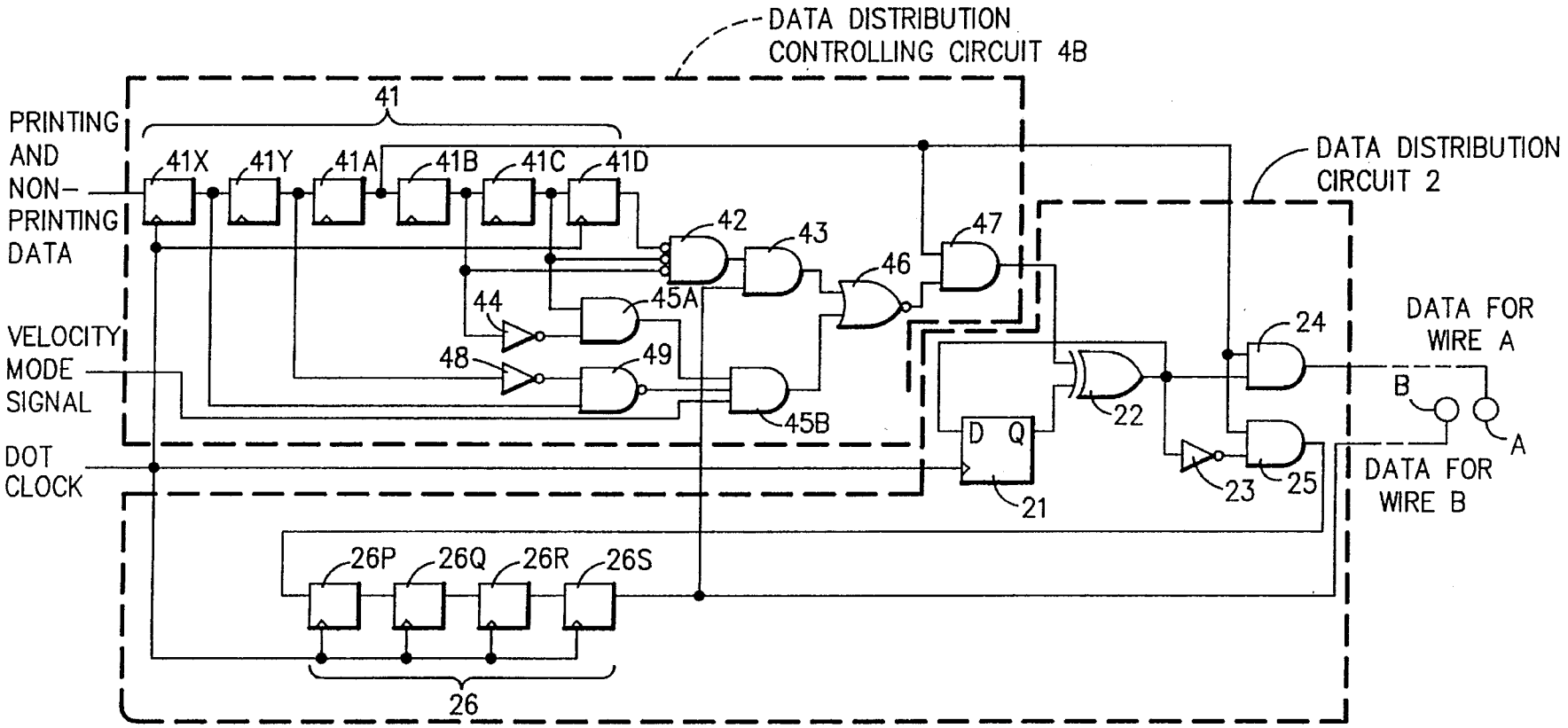
FIG. 3 is a block diagram showing another embodiment of a printing apparatus according to the present invention.

The inverter 48 and the NAND gate 49 in the printing data distribution controlling circuit 4B shown in FIG. 3 form third detection means for detecting that the first non-printing data (corresponding to data at the dot position P2 shown in FIG. 20(3)) between printing data separated from each other at a distance between the wires A and B, then printing data (corresponding to data at the dot position P3 shown in FIG. 20(3)), and then non-printing data and printing data (corresponding to data at the dot positions P4 and P5 shown in FIG. 20(3)) follow, to generate a third detection signal ("0"). That is, the NAND gate 49, on receiving output "1" obtained as a result of inversion of Q output "0" (non-printing data) from the D-FF 41Y by means of the inverter 48 and Q output "1" (printing data) from the D-FF 41X, outputs "0".

The AND gate 45B in the distribution controlling circuit 4B stops, in response to the third detection signal, the control of the distribution circuit 2 by the second control means (a combination of the NOR gate 46 and the AND gate 47). That is, the AND gate 45B, on receiving the third detection signal ("0") from the NAND gate 49, outputs "0". The NOR gate 46 and the AND gate 47 thus output "1", output from the XOR 22 is inverted, and Q output of the D-FF 21 is also inverted. Therefore, printing data (at the dot position P3 shown in FIG. 20(3)) following the above first non-printing data is assigned to a wire (for example, wire A) different from a wire (for example, wire B) to which the preceding printing data (at the dot position P1 shown in FIG. 20(3)) of two printing data separated from each other at a distance between the wires A and B has been assigned and printing data thus are not assigned to only the same wire.

Figure 4:
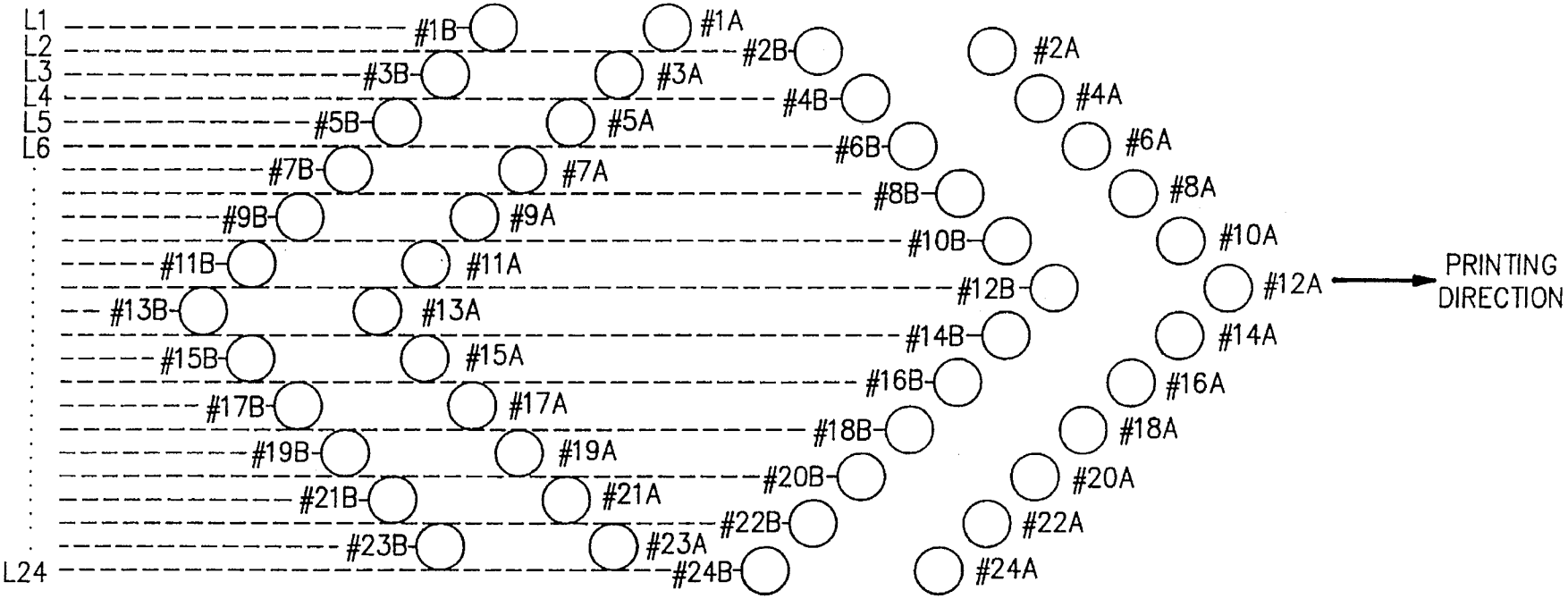
FIG. 4 shows an example of printing wire arrays according to the present invention.

In the embodiments of FIG. 1 and FIG. 3, only two printing wires are provided in one line in the printing direction. However, in the present invention, it will be recognized that two wires can be provided in each of a plurality of lines in the printing direction. FIG. 4 shows an example of printing wire arrays according to the present invention. In the example of FIG. 4, 24 pairs of two wires (1B, 1A), (2B, 2A), (3B, 3A) .. .. (24B, 24A) are provided in 24 respective lines in the printing direction. For each pair of the wires indicated by reference symbols including B and A, the distribution circuit 2 and the distribution controlling circuit 4 or 4B shown in FIG. 1 of FIG. 3, respectively, are provided.

The embodiments of FIG. 1 and FIG. 3 according to the present invention are intended to avoid simultaneously energizing two printing elements in the printing direction. However, as shown in FIG. 5A and FIG. 5B, if printing wires are arranged in a plurality of lines so that a printing wire in each of a plurality of the lines in the printing direction is at a position different from a printing wire in an adjacent line by an integral dot (1.0 dot, that is, odd dot for FIG. 5A, 2.0 dots, that is, even dot for FIG. 5B) in the printing direction, it would be a problem that printing wires in different lines in the printing direction, that is, the printing wires in the direction (the vertical direction in FIG. 5A and FIG. 5B) perpendicular to the printing direction may be simultaneously energized.

Figure 5B:
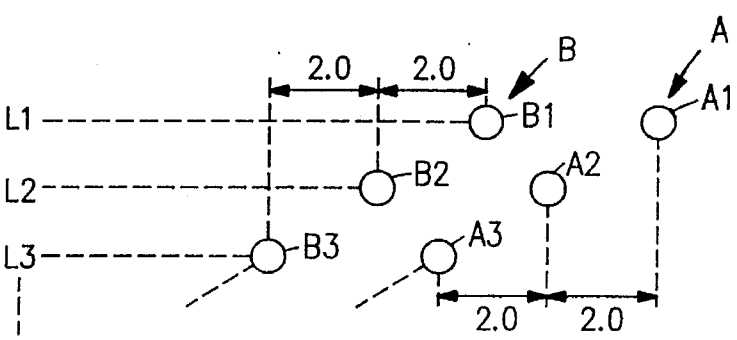
FIG. 5B shows an example of printing wire arrays in which printing wires are arranged in a plurality of lines so that a printing wire in each of a plurality of the lines in the printing direction is at a distance of even dots in the printing direction from a printing wire in an adjacent line.
Figure 5A:
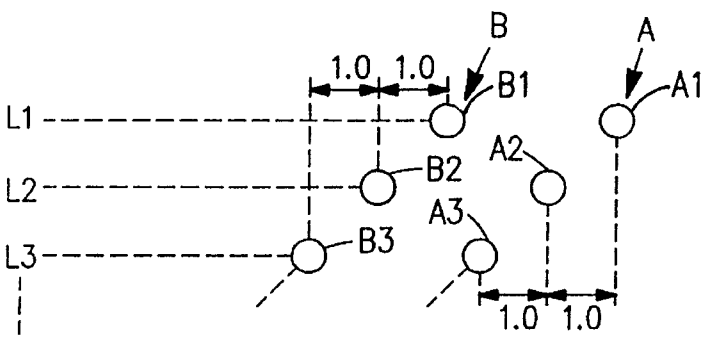
FIG. 5A shows an example of printing wire arrays in which printing wires are arranged in a plurality of lines so that a printing wire in each of a plurality of the lines in the printing direction is at a distance of an odd dot in the printing direction from a printing wire in an adjacent line.
Figure 6:
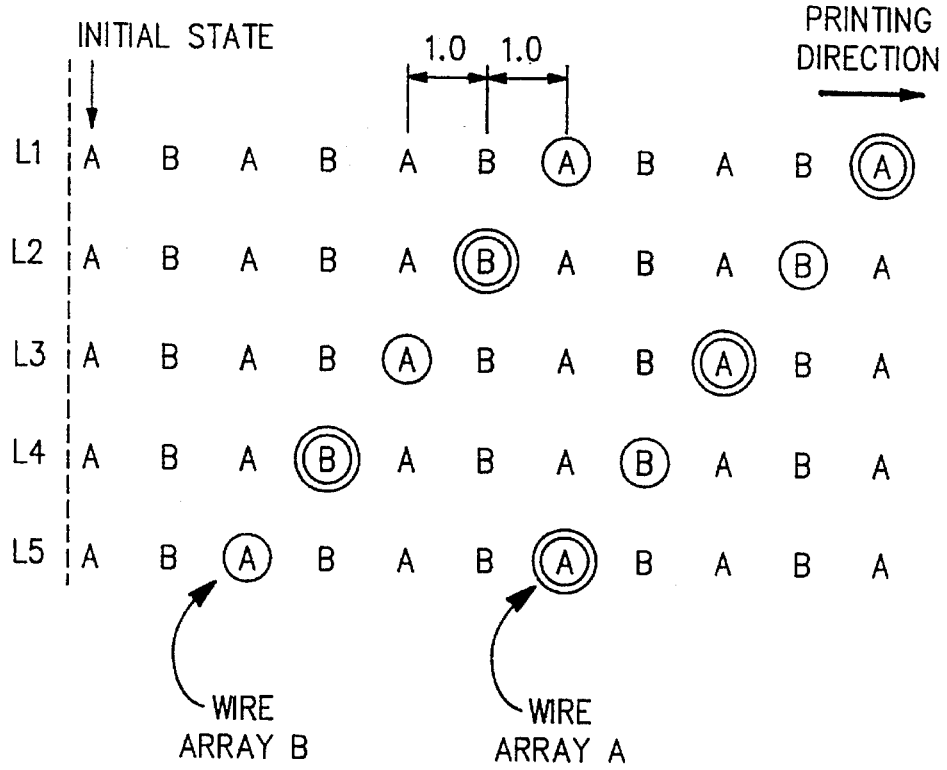
FIG. 6 shows an example of wire assignment in which the number of wires simultaneously energized in the printing wire arrays shown in FIG. 5A is reduced.

As shown in FIG. 5A, in a printing apparatus including printing wire array A in which printing wires A are arranged in a plurality of lines L1, L2, L3 .. .. so that a printing wire A in each of a plurality of the lines L1, L2, L3 .. .. in the printing direction is at a position different from a printing wire A in an adjacent line by odd dot in the printing direction; printing wire array B in which printing wires B are arranged in a plurality of lines L1, L2, L3 .. .. so that a printing wire B in each of a plurality of the lines L1, L2, L3 .. .. is at the same distance (3 dots for the example of FIG. 5A) from each printing wire A of the printing wire array A in a plurality of the lines L1, L2, L3 .. .. ; and driving means for moving the printing wire arrays A and B in the printing direction while a printing medium is fixed, each data of a series of data including printing data and non-printing data, as shown in FIG. 6, may be assigned alternately to the printing wire arrays A and B so that the data is assigned to the same printing wire (for example, wire A) at the same position in a plurality of the lines L1, L2, L3 .. .. in the printing direction. In FIG. 6, A and B indicate that printing data or non-printing data are assigned to the printing wire arrays A and B at respective dot positions. Double-circled A and B indicate that printing data are printed by respective printing wires A and B at respective dot positions. Circled A and B indicate that printing data at respective dot positions are printed by the printing wires A and B rather than the printing wires B and A, respectively. As is obvious from FIG. 6, the number of wires simultaneously energized in the printing wire arrays A and B can be decreased less than the half of the total number of wires.

Figure 7:
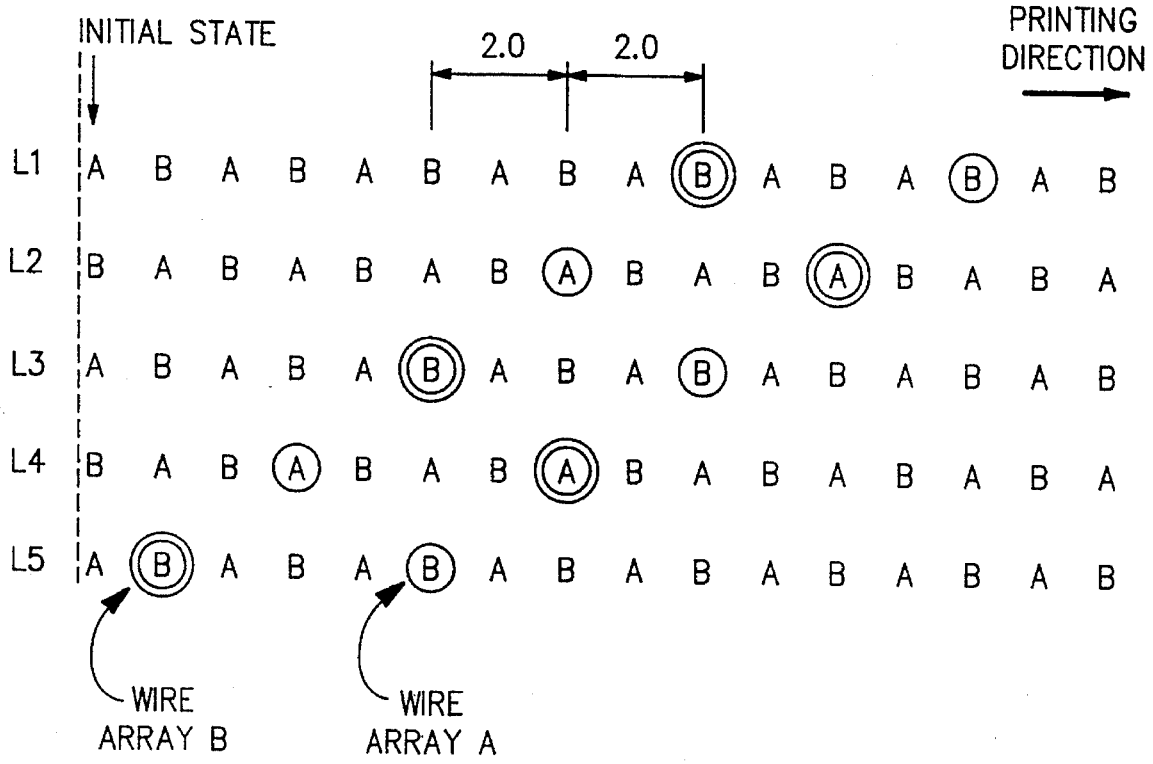
FIG. 7 shows an example of wire arrangement in which the number of wires simultaneously energized in the printing wire arrays shown in FIG. 5B is reduced.

As shown in FIG. 5B, in a printing apparatus including printing wire array A in which printing wires A are arranged in a plurality of lines L1, L2, L3 .. .. so that a printing wire A in each of a plurality of the lines L1, L2, L3 .. .. in the printing direction is at a position different from a printing wire A in an adjacent line by even dot in the printing direction; printing wire array B in which printing wires B are arranged in a plurality of lines L1, L2, L3 .. .. so that a printing wire B in each of a plurality of the lines L1, L2, L3 .. .. is at the same distance (3 dots for the example of FIG. 5A) from each printing wire A of the printing wire array A in a plurality of the lines L1, L2, L3 .. .. ; and driving means for moving the printing wire arrays A and B in the printing direction in state where a printing medium is fixed, each data of a series of data including printing data and non-printing data, as shown in FIG. 7, may be assigned alternately to the printing wire arrays A and B so that the data is assigned to a different printing wire (for example, wire A for Line L1, wire B for line 2) at the same position in adjacent two lines of a plurality of the lines L1, L2, L3 .. .. in the printing direction, to decrease the number of wires simultaneously energized in the printing wire arrays A and B less than the half of the total number of wires.

Figure 8:
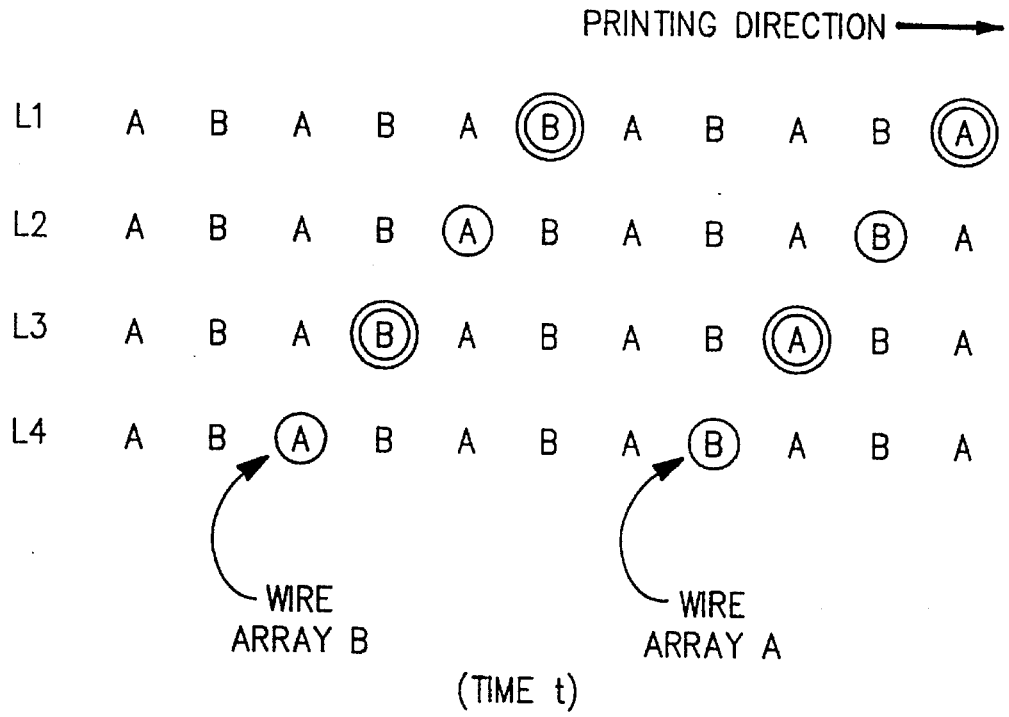
FIG. 8 shows an example of wire arrangement in which the number of wires simultaneously energized in two printing wire arrays, shown in FIG. 5A, separated from each other at a distance of 4 dots is reduced and positions of the printing wire arrays at a time t.
Figure 9:
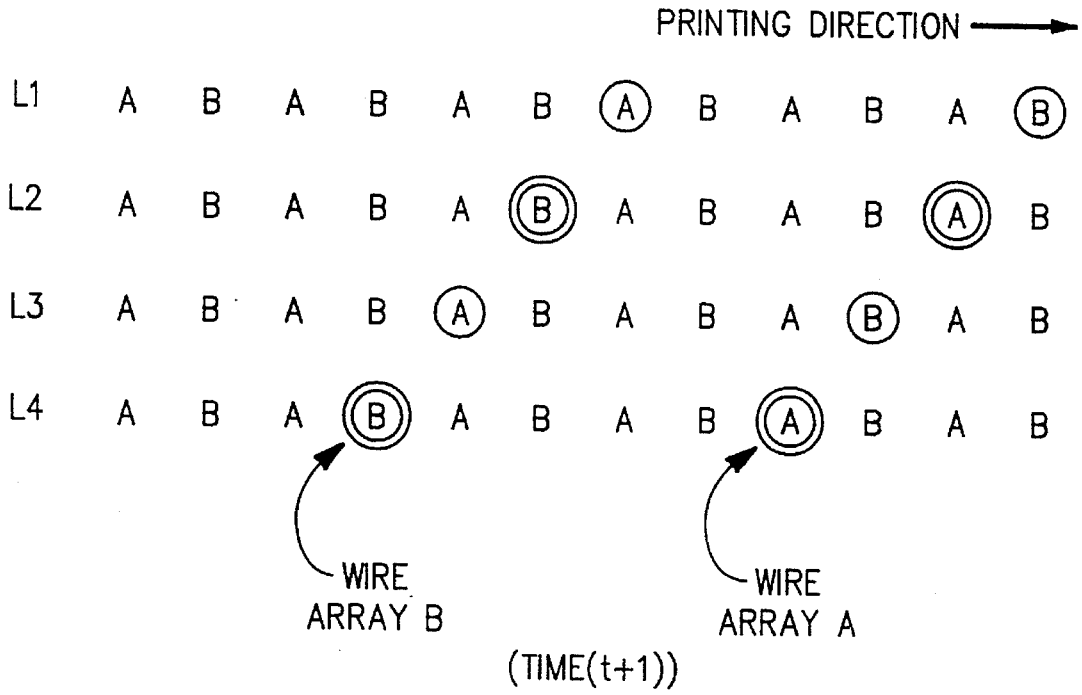
FIG. 9 shows positions of the printing wire arrays at a time t+1 after one dot time elapsed in a state shown in FIG. 8.

FIG. 8 and FIG. 9 show the positions of printing wire arrays A and B at a time t and a time t+1 after one-dot time elapses since t has been started in a case where the printing wire arrays A and B shown in FIG. 6 are arranged separately in a distance corresponding to even dots (four dots for the example). As is obvious from the figures, even if the printing wire arrays A and B are separated from each other by even dots, the number of wires simultaneously energized in the printing wire arrays A and B can be decreased less than the half of the total number of wires.

Figure 10:
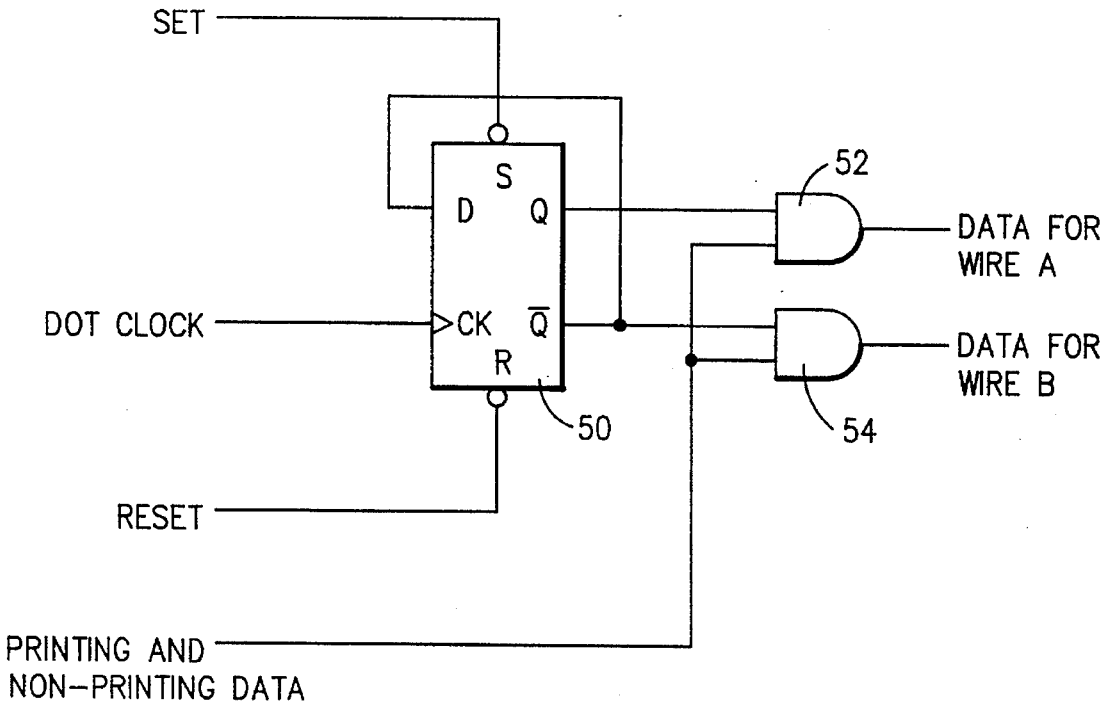
FIG. 10 is a block diagram showing an example of a circuit used for implementing the wire assignments in FIG. 6, FIG. 7, FIG. 8, and FIG. 9.

To put data assignment shown in FIG. 6, FIG. 8, and FIG. 9 into practice, a circuit shown in FIG. 10 is provided for each line of a plurality of the lines L1, L2, L3 .. .. in the printing direction. Referring to FIG. 10, a D-FF 50 for each line sets an initial state, that is, a state of each line at initial dot positions, based on reset input, to Q output of "1" and Q output of "0". The D-FF 50 inverts the Q output and the Q output each time the D-FF 50 receives a dot clock. A Q output of the D-FF 50 connects to one input of an AND gate 52 for a wire A, and a Q output of the D-FF 50 connects to one input of an AND gate 54 for a wire B. The other input of the AND gate 52 and the other input of the AND gate 54 are supplied with printing data ("1") and non-printing data ("0"). Therefore, in all lines in the printing direction; wires A and B are alternately assigned printing data or non-printing data so that the printing or the non-printing data are assigned to the same wire at the same position in the printing direction to implement data assignment shown in FIG. 6, FIG. 8, and FIG. 9.

To put data assignment shown in FIG. 7 into practice, the circuit of FIG. 10 is provided for each line of a plurality of the lines L1, L2, L3 .. .. in the printing direction to set an initial state, that is, a state at initial dot positions in each line of the D-FF 50 for odd lines L1, L3, L5 .. .. , based on reset input, to Q output of "1" and Q output of "0", set an initial state, that is, a state at initial dot positions in each line of the D-FF 50 for even lines L2, L4, L6 .. .. , based on reset input, to Q output of "0" and Q output of "1", and invert the D-FFs 50 for all lines each time a dot clock is reached.

Figure 11:
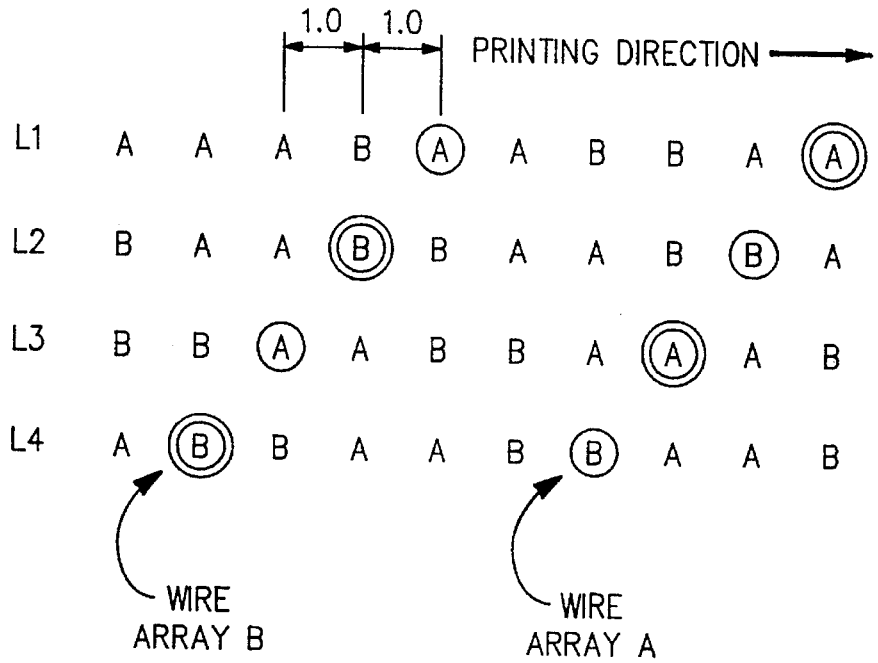
FIG. 11 shows another example of wire assignment in which the number of wires simultaneously energized in the printing wire arrays shown in FIG. 5A is reduced.

As shown in FIG. 5A, in a case where the printing wire array A in which the printing wires A are separated from each other by an odd dot in two adjacent lines in the printing direction and the printing wire array B in which each of the printing wires B is arranged separately from each printing wire A of the printing wire array A by the same integral dots in the printing directions, are used to print the preceding dot of two continuous dots moved by three dots per unit time with the following dot thinned out, it is effective also to put data assignment shown in FIG. 11 into practice. To obtain data assignment shown in FIG. 11, a series of data including printing and non-printing data are alternately assigned by two data to the printing wire arrays A and B so that data assignment to the printing wire arrays A and B at each dot position in adjacent lines (for example, lines L1 and L2) of a plurality of the lines L1, L2, L3 .. .. in the printing direction is made with one dot position offset to assign the printing and the non-printing data to different printing wire arrays every two adjacent dot positions in each of a plurality of the lines in the printing direction. Such data assignment is implemented by providing a circuit shown in FIG. 13 for each of a plurality of the lines L1, L2, L3 .. .. in the printing direction with four lines grouped and setting an initial state different for each group of four lines.

Figure 13:
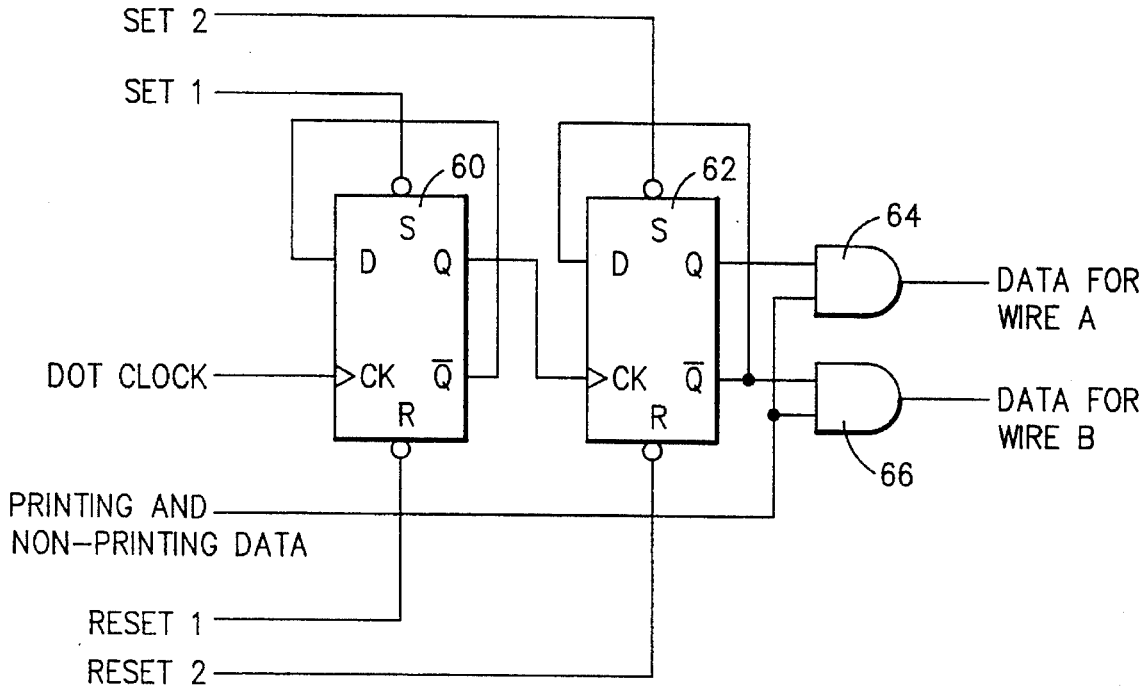
FIG. 13 is a block diagram showing an example of a circuit used for implementing the wire assignments in FIG. 11 and FIG. 12.

Referring to FIG. 13, a Q output of a D-FF 60 connects to a clock input of a D-FF 62, a Q output of the D-FF 60 connects to its D input, and a clock input of the D-FF 60 is supplied with a dot clock indicating a dot position. A Q output of the D-FF 62 connects not only to its D input but also to one input of an AND gate 66 for a wire B and a Q output of the D-FF 62 connects to one input of an AND gate 64 for a wire A. The other input of the AND gate 64 and the other input of the AND gate 66 are supplied with printing and non-printing data.

Both Q outputs of the D-FFs 60 and 62, provided to a first line of the grouped four lines, in the circuit of FIG. 13 are initialized to "1", both Q outputs of the D-FFs 60 and 62, provided to a second line of them, in the circuit are initialized to "0", the Q outputs of the D-FFs 60 and 62, provided to a third line of them, in the circuit are initialized to "1" and "0", respectively, and the Q outputs of the D-FFs 60 and 62, provided to a fourth line of them, in the circuit are initialized to "0" and "1", respectively. A value of the D-FF 62 makes choice of a wire A or a wire B. A value of the D-FF 60 is for divide in inverting every two dots. The D-FF 62 for each line is inverted each time two dot clock pulses are reached to obtain data assignment shown in FIG. 11. As is obvious from FIG. 11, wires simultaneously energized in the wire arrays A and B can be reduced to the half of the total number of wires.

Figure 12:
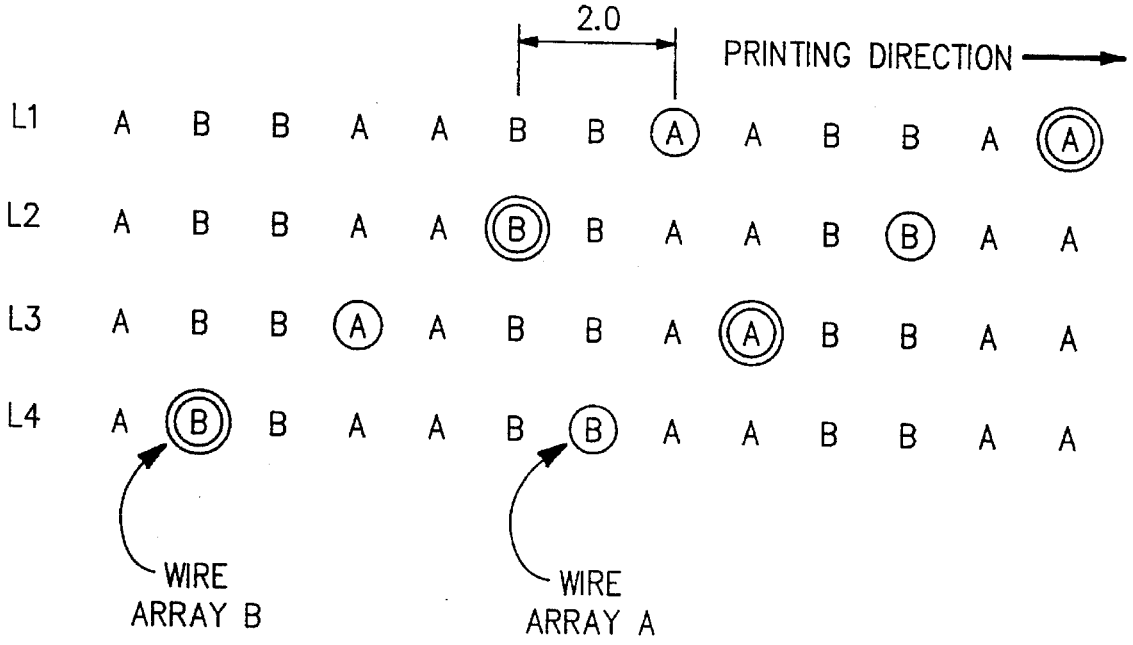
FIG. 12 shows another example of wire arrangement in which the number of wires simultaneously energized in the printing wire arrays shown in FIG. 5B is reduced.

As shown in FIG. 5B, in a case where the printing wire array A in which the printing wires A are separated from each other by even dots in two adjacent lines in the printing direction and the printing wire array B in which each of the printing wires B is arranged separately from each printing wire A of the printing wire array A by the same integral dots in the printing direction, are used to do printing it is effective also to put data assignment shown in FIG. 12 into practice. Data assignment shown in FIG. 12 is obtained from alternately assigning each data of a series of data including printing and non-printing data by two data to the printing wire arrays A and B so that the data is assigned to the same printing wire array at the same position in the printing direction in a plurality of the lines L1, L2, L3 .. .. in the printing direction. Such data assignment is implemented by providing a circuit shown in FIG. 13 for each of a plurality of the lines L1, L2, L3 .. .. in the printing direction and setting the D-FFs 60 and 62 for each line to the same initial state.

Data assignment to the printing wire arrays A and B shown in FIG. 6, FIG. 7, FIG. 8, FIG. 9, FIG. 11, and FIG. 12 means that partial charge of printing at a plurality of dot positions to which the printing wire arrays A and B are positioned is alternately assigned to the printing wire arrays A and B and the circuits shown in FIG. 10 and FIG. 13 can be referred to as means for implementing such assignment of charge of printing.

Figure 14:
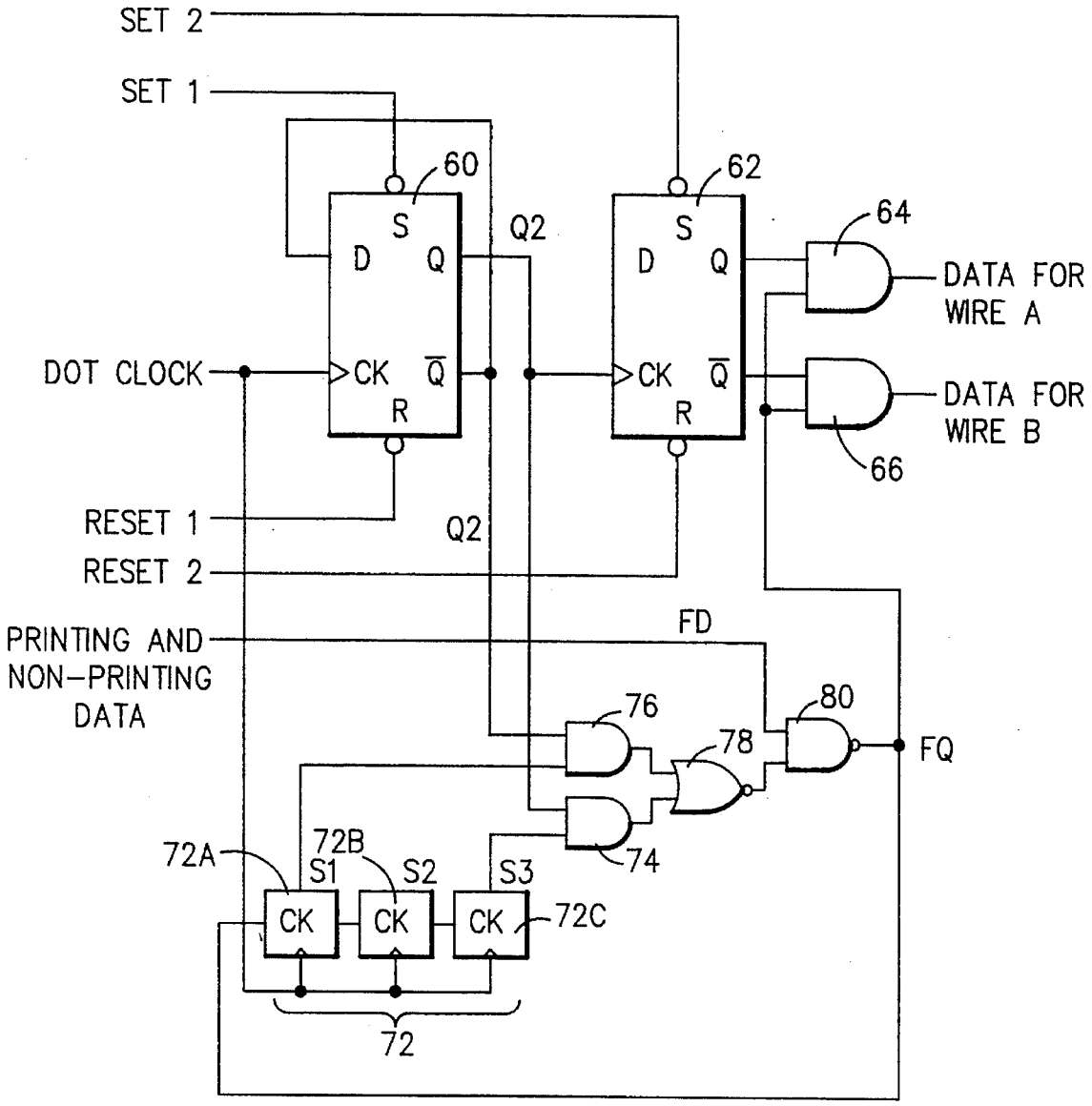
FIG. 14 is a block diagram showing a circuit, suitable for double-speed printing, an improvement on the circuit of FIG. 13.

FIG. 14 shows a circuit, an improvement over the circuit shown in FIG. 13, suitable for double-velocity printing. Referring to FIG. 14, Q output Q2 from the D-FF 60 is supplied not only to a clock input of the D-FF 62, but also to one input of an AND gate 74. Q output Q2 from the D-FF 60 is supplied not only to its D input, but also to one input of an AND gate 76. The other input of the AND gate 74 is supplied with Q output S3 from a three-stage D-FF 72C of a shift register 72 and the other input of the AND gate 76 is supplied with Q output S1 from a first-stage D-FF 72A of the shift register 72. Between the first-stage D-FF 72A and the three-stage D-FF 72C of the shift register 72, a second-stage D-FF 72B is provided.

Outputs from the AND gates 74 and 76 are supplied to one and the other inputs of a NOR gate 78, respectively, output from the NOR gate 78 is supplied to one input of an AND gate 80, and the other input of the AND gate 80 is supplied with printing or non-printing data FD. Output FQ from the AND gate 80 is supplied not only to a D input of the first-stage D-FF 72A of the shift register 72, but also to one input of the AND gate 64 for wire A and one input of the AND gate 66 for wire B, and the other input of the AND gate 64 and the other input of the AND gate 66 connect to the Q output and the Q output of the D-FF 62. The clock input of the D-FF 60, and clock inputs of the 72A, 72B, and 72C are supplied with dot clock pulses indicating dot positions.

In the circuit of FIG. 14, data FQ supplied to the AND gates 64 and 66 for wires A and B is expressed as follows:

$$FQ=FD(Q2\ S1+Q2\ S3)$$

The expression denotes that in data assignment for every two dots shown in FIG. 15, printing is done at a position (1) if printing data is not present at a position D3 of the first of three dots preceding the position (1) and printing is done at position (2) if printing data is not preset at a position D1 immediately before the position (2).

In the above embodiments, the printing wires can be moved while a printing medium is fixed. However, it will be appreciated that the printing medium may be moved in the printing direction with the printing wires stopped, that is, the printing wires can be moved relative to the printing medium in the printing direction.

In the above embodiments, wires are used as printing elements. However, it will be appreciated also that for example, heating elements, ink-jetting elements, etc. may be used as printing elements.

As is obvious from the above description, according to the present invention, the number of printing elements simultaneously energized can be reduced to avoid a consuming energy peak in printing and a distance between printing elements in the printing direction can be set to an integral pitch.

What is claimed is:

1. A printing apparatus, comprising:

at least two printing elements which can be moved relative to a printing medium in a printing direction and which are provided in the same line in the printing direction at a predetermined distance apart in the printing direction, and which print in response to a series of data including printing data indicating that printing is to be done and non-printing data indicating that printing is not to be done; and means to prevent the simultaneous activation of printing elements, said means including data assignment means for assigning two printing data at positions in the series of data corresponding to said predetermined distance of the two printing elements, to only one of said two printing elements regardless of any printing data or non-printing data between such two printing data in the series.

2. The printing apparatus according to claim 1, wherein said data assignment means comprises:

data distribution means for distributing printing data in said series of data, alternately to said two printing elements; and data distribution controlling means for controlling said data distribution means so that if two printing data exist in a series of said data at positions in the data series corresponding to said predetermined distance of the two printing elements, the following printing data, which is one of said two printing data, is always distributed to the same printing element to which the preceding printing data, which is the other of said two printing data, is distributed.

3. The printing apparatus according to claim 2, wherein said data distribution controlling means controls said data distribution means so that if only non-printing data exists or if an even number of printing data exists between said two printing data, the following printing data, which is one of said two printing data, is distributed to the same printing element to which the preceding printing data, which is the other of said two printing data, is distributed.

4. The printing apparatus according to claim (2), wherein said data distribution controlling means comprises:

first detection means for detecting the presence of only non-printing data between said two printing data to generate a first detection signal; and first control means for controlling said distribution means so that the following printing data, which is one of said two printing data, is distributed, in response to said first detection signal generated, to the same printing element to which the preceding printing data, which is the other of said two printing data, is distributed.

5. The printing apparatus according to claim (2), wherein:

said two printing elements are separated from each other by odd dots; and said distribution controlling means comprises:

second detection means further for detecting printing data following the first non-printing data between said two printing data to generate a second detection signal; and second control means responsive to said second detection signal for controlling said distribution means so that printing data which appears immediately after said first non-printing data is distributed to the same printing element to which printing data which appears immediately before said first non-printing data is distributed.

6. The printing apparatus according to claim (5), wherein said distribution controlling means further comprises:

third detection means for detecting that printing data follows said first non-printing data, then non-printing data and printing data follow to generate a third detection signal; and third control means responsive to said third detection signal for stopping the control of said distribution means under said second control means.

7. Apparatus for printing at predetermined positions on a medium comprising:

a plurality of printing element arrays of a plurality of printing elements, each in a plurality of lines in a printing direction with elements of each array in different such lines and a plurality of the lines having at least two elements from different arrays and with printing elements of the same array in adjacent such lines separated in the printing direction by an integer times an offset in the printing direction between printing positions on a print medium, and moveable relative to the printing medium in the printing direction, and which print in response to a series of data including printing data indicating that printing is to be done and non-printing data indicating that printing is not to be done; and means to prevent the simultaneous activation of printing elements, said means including printing assignment means for decreasing the number of wires in each array which are simultaneously energized by presetting a printing assignment of the plurality of printing element arrays to each printing position of the printing medium.

8. The apparatus of claim 7, wherein:

the printing element arrays include:

a first printing element array; and a second printing element array in which printing elements are at the same distance in the printing direction from a respective printing elements of the first printing element array in a plurality of the lines; and the printing assignment means alternates printing assignment of the first and second printing element arrays to sequential printing positions in lines in the printing direction.

9. The apparatus of claim 8, wherein:

a printing element of one printing element array in one line and a printing element of the one array in an adjacent line are separated in the printing direction by an even integer times a pitch of the printing positions; and the printing assignment means comprises data distribution means for alternately assigning data in the series of data to different printing element arrays so that only data assigned to the same printing element array prints in the same column of printing positions on the printing medium.

10. The apparatus of claim 8, wherein:

a printing element in each line of one printing element array and a printing element in an adjacent line of the one array are separated in the printing direction by an even integer times the offset between printing positions; and the printing assignment means comprises data distribution means for alternately assigning data in the series of data to different printing element arrays so that data assigned to different printing element arrays print in the same column of print positions position in two adjacent lines in the print direction.

11. The apparatus of claim 8, wherein:

a printing element in each line of one printing element array and a printing element in an adjacent line of the one array are separated by an odd integer times the offset between printing positions in the printing direction; and the printing assignment means comprise data distribution means for alternately assigning data in the data stream a pair at a time to two different printing element arrays every two adjacent printing positions in the printing direction so that data assignment to said printing element arrays in each column of printing positions in adjacent lines is done with an offset of one printing position.

12. The apparatus to claim 7, wherein:

a printing element in each line of one printing element array and a printing element of the one array in an adjacent line are separated in the printing direction by an even integer times the offset between printing positions; and the printing assignment means comprise data distribution means for alternately assigning data in the data stream a pair at a time to different element arrays so that a series of the data are assigned to the same printing element array at the same column of printing positions of a plurality of said lines.

13. Apparatus for printing at predetermined positions on a medium comprising:

printing elements moveable in relation to the medium in a printing direction, including printing elements aligned in the printing direction separated by an integer times the offset between printing positions; and means to prevent the simultaneous activation of printing elements, said means including assignment means to selectively assign printing elements for reducing the frequency of simultaneous energizing of printing elements to a frequency below that resulting from always alternately assigning printing data to printing elements aligned in the printing direction.

14. The apparatus of claim 13 which:

the printing elements include arrays of plural elements of different respective lines in the printing direction; and reduction means include means for reducing the simultaneous energizing of printing elements in an array.

15. The apparatus of claim 13 which further include means for assigning a plurality of printing elements in one line to different printing positions in the line, and in which reduction means include dynamic means to change the normal assignment of data for reducing the number of printing elements in each respective line which are simultaneously energized.

16. Apparatus for printing at predetermined positions on a medium comprising:

at least two printing elements which can be moved relative to the printing medium in a printing direction, and which are aligned in the printing direction at a predetermined distance apart, and which print in response to a series of data including printing data indicating that printing is to be done and non-printing data indicating that printing is not to be done; and means to prevent the simultaneous activation of printing elements, said means including data assignment means to consistently assign two printing data in the series and separated by other data of a number corresponding to said predetermined distance between the two printing elements, to only one of said two printing elements.

17. The apparatus of claim 16, wherein the data assignment means comprise:

data distribution means for alternately distributing printing data, to said two printing elements; and data distribution controlling means for controlling the data distribution means so that if two printing data including a previous printing data and a following printing data exist in a series of said data in positions corresponding to the predetermined distance of the two printing elements, the following printing data is distributed to the same printing element to which the preceding printing-data is distributed.

18. The apparatus of claim 17, wherein the data distribution controlling means includes means for controlling the data distribution means so that the following printing data are distributed to the same printing element to which as the preceding printing data is distributed if only non-printing data exists or if an even number of printing data exist between the two printing data.

19. The apparatus of claim 17, wherein the data distribution controlling means comprise:

first detection means for detecting the presence of only non-printing data between the two printing data and for generating a first detection signal in response to the presence; and first control means for controlling the distribution means in response to the first detection signal, so that the following printing data is distributed, to the same printing element as the preceding printing data is distributed.

20. The apparatus of claim 17, wherein:

the two printing elements are separated from each other by an odd integer times the distance between printed characters; and the distribution controlling means further comprises:

second detection means for detecting printing data following a first non-printing data between the two printing data and for generating a second detection signal in response to the detecting; and second control means responsive to said second detection signal for controlling the distribution means so that printing data, immediately after the first non-printing data in the series, is distributed to the same printing element to which printing data, immediately before said first non-printing data, is distributed.

21. The apparatus of claim 17, wherein the distribution controlling means further comprise:

third detection means for detecting that a first printing data follows the first non-printing data, then that additional non-printing data and printing data follow the first printing data and for generating a third detection signal in response to the detection; and third control means responsive to the third detection signal for stopping the control of the distribution means under the second control means.

* * * * *